US009939743B2

(12) United States Patent
Hoshizaki

(10) Patent No.: US 9,939,743 B2
(45) Date of Patent: Apr. 10, 2018

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Taketoshi Hoshizaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/453,395

(22) Filed: Mar. 8, 2017

(65) Prior Publication Data

US 2018/0067408 A1 Mar. 8, 2018

(30) Foreign Application Priority Data

Sep. 5, 2016 (JP) ..... 2016-172942

(51) Int. Cl.

| | |
|---|---|
| ***G03G 5/00*** | (2006.01) |
| ***G03G 5/04*** | (2006.01) |
| ***G03G 21/18*** | (2006.01) |
| ***G03G 5/14*** | (2006.01) |

(52) U.S. Cl.

CPC ..... *G03G 5/04* (2013.01); *G03G 5/14* (2013.01); *G03G 5/142* (2013.01); *G03G 5/144* (2013.01); *G03G 21/18* (2013.01)

(58) Field of Classification Search

CPC ..... G03G 5/14; G03G 5/142; G03G 5/144
USPC ..... 430/60, 63, 65
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Katsumi et al. | |
| 2009/0162097 | A1 | 6/2009 | Fuchigami | |
| 2013/0316275 | A1* | 11/2013 | Kawasaki | G03G 5/144 430/56 |

FOREIGN PATENT DOCUMENTS

| | | | |
|---|---|---|---|
| EP | 0 710 893 | A1 | 5/1996 |
| JP | 4-189873 | A | 7/1992 |
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 8-176293 | A | 7/1996 |
| JP | 8-208820 | A | 8/1996 |
| JP | 2000-347433 | A | 12/2000 |
| JP | 2004-078147 | A | 3/2004 |
| JP | 2005-181992 | A | 7/2005 |
| JP | 2007-94226 | A | 4/2007 |
| JP | 2010-145473 | A | 7/2010 |
| JP | 2010-152406 | A | 7/2010 |
| JP | 2012-155282 | A | 8/2012 |

* cited by examiner

*Primary Examiner* — Mark A Chapman
(74) *Attorney, Agent, or Firm* — Sughrue Mion, PLLC

(57) ABSTRACT

An electrophotographic photoreceptor includes a conductive substrate; an undercoat layer disposed on the conductive substrate and containing a binder resin, metal oxide particles, and an electron-accepting compound having an anthraquinone structure; and a photosensitive layer disposed on the undercoat layer, wherein the reflectance RL of the undercoat layer for light having a wavelength ranging approximately from 470 nm to 510 nm is approximately from 2% to 5%.

10 Claims, 4 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-172942 filed Sep. 5, 2016.

BACKGROUND

(i) Technical Field

The present invention relates to an electrophotographic photoreceptor, a process cartridge, and an image forming apparatus.

(ii) Related Art

Electrophotographic image forming apparatuses are used in image forming apparatuses such as copying machines and laser beam printers. The mainstream of electrophotographic photoreceptors used in image forming apparatuses is an organic photoreceptor containing an organic photoconductive material. In general production of the organic photoreceptor, for example, an undercoat layer (also referred to as "intermediate layer") is formed on a conductive substrate, such as an aluminum substrate, and then a photosensitive layer is formed thereon.

SUMMARY

The invention has the following aspects to accomplish this object.

According to an aspect of the invention, there is provided an electrophotographic photoreceptor including a conductive substrate; an undercoat layer disposed on the conductive substrate and containing a binder resin, metal oxide particles, and an electron-accepting compound having an anthraquinone structure; and a photosensitive layer disposed on the undercoat layer, wherein the reflectance RL of the undercoat layer for light having a wavelength ranging approximately from 470 nm to 510 nm is approximately from 2% to 5%.

BRIEF DESCRIPTION OF THE DRAWINGS

Exemplary embodiments of the present invention will be described in detail based on the following figures, wherein.

DETAILED DESCRIPTION

Figure 1:
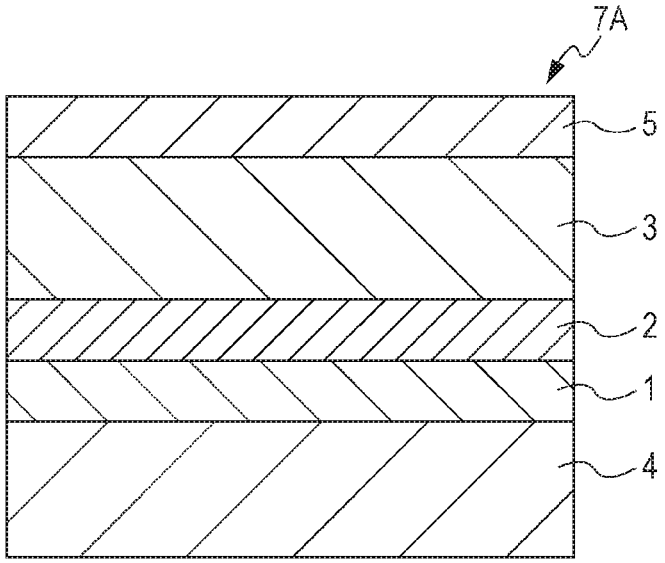
FIG. 1 is a schematic cross-sectional view partially illustrating an example of the layered structure of an electrophotographic photoreceptor according to a first exemplary embodiment.

Exemplary embodiments that are examples of the invention will now be described in detail.

Electrophotographic Photoreceptor

An electrophotographic photoreceptor according to a first exemplary embodiment (hereinafter also referred to as "photoreceptor") includes a conductive substrate, an undercoat layer disposed on the conductive substrate, and a photosensitive layer disposed on the undercoat layer. The undercoat layer contains a binder resin, metal oxide particles, and an electron-accepting compound having an anthraquinone structure (hereinafter also referred to as "electron-accepting anthraquinone compound") and has a reflectance RL ranging approximately from 2% to 5% for light having a wavelength that is approximately in the range of 470 nm to 510 nm.

Such a structure of the photoreceptor of the first exemplary embodiment enables a reduction in the occurrence of ghosts (occurrence of afterimages in which images previously formed remain on images formed later in continuous formation of images). It is speculated that such a reduction in the occurrence of ghosts is given owing to the following mechanism.

In electrophotographic image formation, a photoreceptor is charged and then exposed to light for formation of an electrostatic latent image. The exposure of the photoreceptor to light causes the attenuation of the surface potential thereof; in this process, electric charges move at the interface between the photosensitive layer (for example, a charge-generating layer in a functionally-separated photosensitive layer) and the undercoat layer. In the undercoat layer containing a binder resin, metal oxide particles, and an electron-accepting anthraquinone compound, electric charges move via the metal oxide particles, and the electron-accepting anthraquinone compound helps the electric charges to transfer.

In the case where the distribution of the metal oxide particles is not substantially even and dense in the part of the undercoat layer around the interface with the photosensitive layer, it is believed that the transfer of the electric charges at the interface between the photosensitive layer and the undercoat layer is inhibited and that the electric charges are therefore accumulated at the interface between the photosensitive layer and the undercoat layer. Continuous formation of images in this state (in other words, repeated charging and exposure of the photoreceptor) causes electric charges to be accumulated at the interface between the photosensitive layer and the undercoat layer, and the accumulated electric charges are presumed to cause ghosts.

The electron-accepting anthraquinone compound has a strong absorption of light having a wavelength ranging approximately from 470 nm to 510 nm. Hence, when the undercoat layer containing the electron-accepting anthraquinone compound reflects light having a wavelength ranging approximately from 470 nm to 510 nm, the reflected light does not contain the component of transmitted light (namely, component of light that has passed through the undercoat layer and that is then reflected from the conductive substrate) or, if any, contains very a few thereof. The reflected light therefore contains only the component of light reflected from the surface of the undercoat layer and the component of scattered light from the surroundings of the surface. In particular, the amount of the component of scattered light from the surroundings of the surface reflects the state of the dispersion of the metal oxide particles (specifically, state of aggregate).

Specifically, the more the metal oxide particles aggregate (namely, in a state in which the distribution of the metal oxide particles is not even and dense), the more light is scattered by the metal oxide particles, which results in an increase in the component of scattered light. In other words, the reflectance RL of the undercoat layer for light having a wavelength ranging approximately from 470 nm to 510 nm increases. In contrast, the less the metal oxide particles aggregate (namely, in a state in which the distribution of the metal oxide particles is substantially even and dense), the less light is scattered by the metal oxide particles, which results in a decrease in the component of the scattered light. In other words, the reflectance RL of the undercoat layer for light having a wavelength ranging approximately from 470 nm to 510 nm decreases.

The more the metal oxide particles aggregate, the more the transfer of electric charges at the interface between the photosensitive layer and the undercoat layer is inhibited; thus, the electric charges are accumulated at the interface between the photosensitive layer and the undercoat layer, which results in the easy occurrence of ghosts. Also in the case where the aggregate of the metal oxide particles is unnecessarily inhibited (namely, in a state in which the distribution of the metal oxide particles is substantially unnecessarily even and dense), ghosts are likely to occur. This is believed to occur for the following mechanism. In a state in which parts through which electric charges are injected have a moderate disturbance, electric charges may be injected from parts easy to intrude; however, in a state in which the distribution of electric charges is unnecessarily dense, parts through which electric charges are easily injected are a few, and thus the electric charges are likely to be accumulated.

The reflectance RL of the undercoat layer for light having a wavelength ranging approximately from 470 nm to 510 nm is therefore adjusted to be approximately from 2% to 5%, and the degree of the aggregate of the metal oxide particles is controlled to be in an appropriate state (namely, in a state in which the distribution of the metal oxide particles is properly substantially even and dense). This enables a reduction in the inhibition of the transfer of electric charges at the interface between the photosensitive layer and the undercoat layer, so that the accumulation of the electric charges at the interface therebetween is reduced.

The photoreceptor of the first exemplary embodiment is believed to reduce the occurrence of ghosts owing to the mechanism described above.

The electrophotographic photoreceptor of the first exemplary embodiment will now be described in detail with reference to the drawings.

Figure 2:
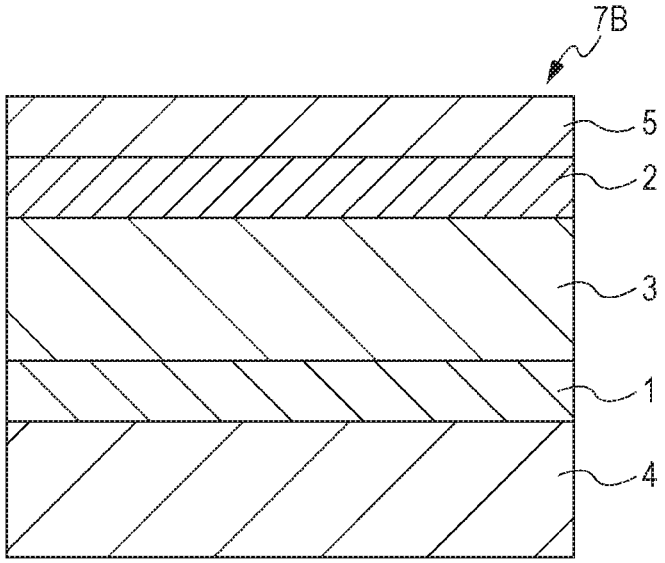
FIG. 2 is a schematic cross-sectional view partially illustrating another example of the layered structure of the electrophotographic photoreceptor according to the first exemplary embodiment.
Figure 3:
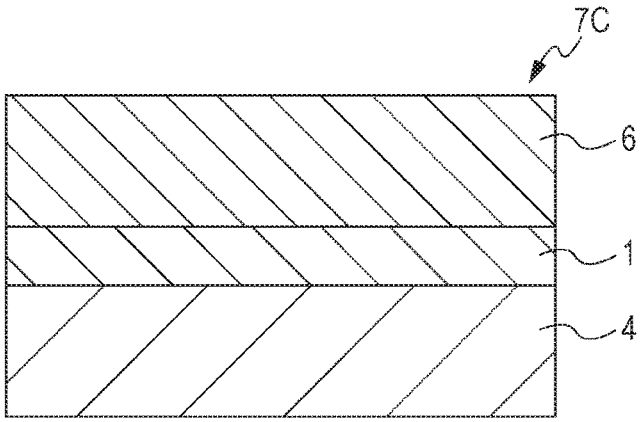
FIG. 3 is a schematic cross-sectional view partially illustrating another example of the layered structure of the electrophotographic photoreceptor according to the first exemplary embodiment.

FIG. 1 is a schematic cross-sectional view illustrating an example of the electrophotographic photoreceptor of the first exemplary embodiment. FIGS. 2 and 3 are each a schematic cross-sectional view illustrating another example of the electrophotographic photoreceptor of the first exemplary embodiment.

An electrophotographic photoreceptor 7A illustrated in FIG. 1 is a so-called functionally-separated photoreceptor (layered photoreceptor) and includes a conductive substrate 4; an undercoat layer 1 formed thereon; and a charge-generating layer 2, charge-transporting layer 3, and protective layer 5 disposed in sequence so as to overlie the conductive substrate 4 and the undercoat layer 1. In the electrophotographic photoreceptor 7A, the charge-generating layer 2 and the charge-transporting layer 3 constitute a photosensitive layer.

An electrophotographic photoreceptor 7B illustrated in FIG. 2 is a functionally-separated photoreceptor in which the charge-generating layer 2 and the charge-transporting layer 3 are functionally separated as in the electrophotographic photoreceptor 7A illustrated in FIG. 1.

The electrophotographic photoreceptor 7B illustrated in FIG. 2 includes the conductive substrate 4; the undercoat layer 1 formed thereon; and the charge-transporting layer 3, charge-generating layer 2, and protective layer 5 disposed in sequence so as to overlie the conductive substrate 4 and the undercoat layer 1. In the electrophotographic photoreceptor 7B, the charge-transporting layer 3 and the charge-generating layer 2 constitute a photosensitive layer.

In an electrophotographic photoreceptor 7C illustrated in FIG. 3, a charge-generating material and a charge-transporting material are used in a single layer (single photosensitive layer 6). The electrophotographic photoreceptor 7C illustrated in FIG. 3 includes the conductive substrate 4, the undercoat layer 1 formed thereon, and the single photosensitive layer 6 disposed so as to overlie the conductive substrate 4 and the undercoat layer 1.

Each part of the electrophotographic photoreceptor 7A illustrated in FIG. 1 will now be described as a representative example. Reference signs are omitted for the sake of convenience.

Conductive Substrate

Examples of the conductive substrate include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

In the case where the electrophotographic photoreceptor is used in a laser printer, the surface of the conductive substrate is suitably roughened to a center line average roughness Ra ranging from 0.04 μm to 0.5 μm in order to reduce interference fringes generated on radiation of laser light. The roughening for the reduction in interference fringes does not need to be performed when incoherent light is emitted from a light source; however, roughening the surface of the conductive substrate reduces generation of the defect thereof, which leads to prolonged product lifetime.

Examples of a technique for the roughening include wet honing in which an abrasive is suspended in water and then sprayed to the conductive substrate, centerless grinding in which a rotating grindstone is pressed against the conductive substrate to continuously grind it, and anodic oxidation.

Another roughening technique may be used; for instance, conductive or semi-conductive powder is dispersed in resin, and the layer thereof is formed on the surface of the conductive substrate, and the particles dispersed in the layer serve for the roughening without directly roughening the surface of the conductive substrate.

In the roughening by anodic oxidation, a conductive substrate formed of metal (e.g., aluminum) serves as an anode for the anodic oxidation in an electrolyte solution, thereby forming an oxidation film on the surface of the conductive substrate. Examples of the electrolyte solution include a sulfuric acid solution and an oxalic acid solution. A porous anodic oxidation film formed by anodic oxidation is, however, chemically active in its original state; thus, it is easily contaminated and suffers from a great change in resistance depending on environment. Accordingly, the pores of the porous anodic oxidation film are suitably closed owing to volume expansion resulting from a hydration reaction in pressurized steam or in boiled water (metal salt such as nickel is optionally added) to turn the oxidation film to more stable hydrous oxide.

The thickness of the anodic oxidation film is, for example, suitably from 0.3 μm to 15 μm. At a thickness in such a range, barrier properties to injection are likely to be given, and an increase in the residual potential due to repeated use is likely to be reduced.

The conductive substrate is optionally subjected to a treatment with an acidic treatment liquid or a boehmite treatment.

An example of the treatment with an acidic treatment liquid is as follows. An acidic treatment liquid containing a phosphoric acid, a chromic acid, and a hydrofluoric acid is prepared. The amounts of the phosphoric acid, chromic acid, and hydrofluoric acid in the acidic treatment liquid are, for instance, in the range of 10 weight % to 11 weight %, 3 weight % to 5 weight %, and 0.5 weight % to 2 weight %, respectively; the total concentration of the whole acids are suitably from 13.5 weight % to 18 weight %. The treatment temperature is, for example, suitably in the range of 42° C. to 48° C. The thickness of the coating film is suitably from 0.3 μm to 15 μm.

The boehmite treatment, for instance, involves a soak in pure water at a temperature ranging from 90° C. to 100° C. for 5 to 60 minutes or contact with heated steam at a temperature ranging from 90° C. to 120° C. for 5 to 60 minutes. The thickness of the coating film is suitably from 0.1 μm to 5 μm. The coating film is optionally further subjected to an anodic oxidation treatment with an electrolyte solution that less dissolves the coating film, such as adipic acid, boric acid, borate, phosphate, phthalate, maleate, benzoate, tartrate, or citrate.

Undercoat Layer

The undercoat layer contains a binder resin, metal oxide particles, and an electron-accepting anthraquinone compound. The reflectance RL of the undercoat layer for light having a wavelength ranging approximately from 470 nm to 510 nm is approximately from 2% to 5%.

The reflectance RL is approximately from 2% to 5%; in terms of a reduction in the occurrence of ghosts, it is preferably approximately from 2% to 4%.

In order to adjust the reflectance RL, the state of the aggregate of the metal oxide particles is controlled by changing the conditions in stirring of a coating liquid used for forming the undercoat layer. In particular, for example, in order to give the reflectance RL ranging approximately from 2% to 5%, the stirring is carried out with a stirrer at a high number of rotations and subsequently at a low number of rotations. Alternatively, the stirring may be carried out alternately at a high number of rotations and a low number of rotations. In addition, a change in the thickness of the undercoat layer enables the state of the aggregate of the metal oxide particles to be controlled, so that the reflectance RL can be adjusted.

The percentage of the reflectance RL of the undercoat layer for light having a wavelength ranging approximately from 470 nm to 510 nm to the reflectance RH thereof for light having a wavelength ranging approximately from 750 nm to 800 nm is preferably approximately in the range of 5% to 20%, more preferably approximately 5% to 15%, and further preferably approximately 7% to 10%.

The electron-accepting anthraquinone compound has no absorption of light having a wavelength ranging approximately from 750 nm to 800 nm or, if any, low absorption thereof. Hence, when the light having a wavelength ranging approximately from 750 nm to 800 nm is reflected, the reflected light contains the component of transmitted light (namely, component of light that has passed through the undercoat layer and that is then reflected from the conductive substrate) in addition to the component of the light reflected from the surface and the component of scattered light from the surroundings of the surface. Accordingly, the reflectance RH of the undercoat layer for light having a wavelength ranging approximately from 750 nm to 800 nm corresponds to the reflectance of the whole undercoat layer for the light having a wavelength ranging approximately from 750 nm to 800 nm. Adjusting the reflectance RL relative to the reflectance RH corresponding to the reflectance of the whole undercoat layer to be within the above-mentioned range enables a reduction in the occurrence of ghosts, although the mechanism thereof has been still studied.

The light reflectance of the undercoat layer is measured as follows.

Figure 6:
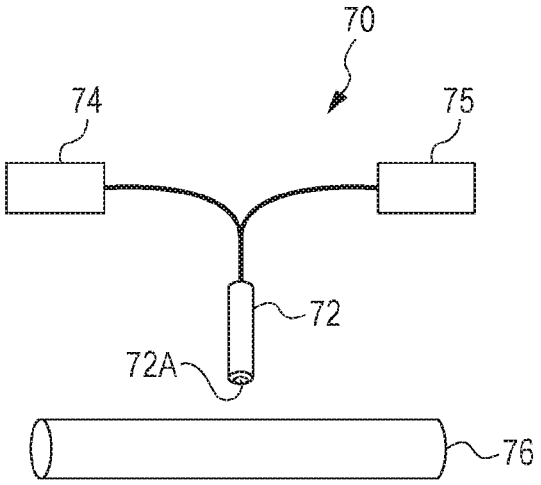
FIG. 6 schematically illustrates a device used for measuring the reflectance of an undercoat layer.

A measuring device that is to be used will now be described. As illustrated in FIG. 6, a measuring device 70 includes an optical fiber bundle (diameter: 1 mm), a bifurcated light guide 72 having a light-emitting-and-receiving surface 72A that emits light to a measurement object and that receives reflected light, a light source 74 (halogen lamp) attached to one end of the branched part of the bifurcated light guide 72, and a spectrophotometer 75 (MPCD-3000 manufactured by Otsuka Electronics Co., Ltd.) attached to the other end of the branched part thereof. In FIG. 6, the reference number 76 denotes the conductive substrate on which the undercoat layer has been formed.

In the measuring device 70, the light source 74 generates light, and the generated light is emitted from the light-emitting-and-receiving surface 72A of the bifurcated light guide 72 to a measurement object. The emitted light is reflected and then received by the light-emitting-and-receiving surface 72A of the bifurcated light guide 72, and the spectrum of the reflected light is measured by the spectrophotometer 75.

In the light-emitting-and-receiving surface 72A, the edge surface in the optical fiber bundle has random arrangement of the edge surfaces of light-emitting optical fibers and the edge surfaces of light-receiving optical fibers.

The measuring device 70 is used to emit light, which is generated in the light source 74, from the light-emitting-and-receiving surface 72A of the bifurcated light guide 72 to the surface of a measurement object that is the undercoat layer formed on the conductive substrate. The emitted light is reflected and then received by the light-emitting-and-receiving surface 72A of the bifurcated light guide 72, and the intensity of the reflected light having a wavelength ranging from 400 nm to 800 nm is measured by the spectrophotometer 75.

In the measurement, the light-emitting-and-receiving surface 72A of the bifurcated light guide 72 is placed so as to face the surface of the undercoat layer at an interval of ten times the diameter of the optical fiber bundle (diameter: 1 mm, that is, the interval is 10 mm) such that the direction of the emitted light is along the direction orthogonal to the axial direction of the conductive substrate (in other words, such that the emitted light and reflected light are in the direction orthogonal to the axial direction of the conductive substrate).

Meanwhile, the intensity of light reflected from a mirror surface formed by depositing an aluminum on a glass substrate is measured at the same conditions within the wavelength range from 400 nm to 800 nm, and the measured intensity is defined as the reference intensity. The percentage of the intensity of the light reflected from the undercoat layer to the reference intensity is defined as the light reflectance of the undercoat layer.

The average of the percentage of the intensity of the light reflected from the undercoat layer to the reference intensity within the wavelength range approximately from 470 nm to 510 nm is defined as the reflectance for light having a wavelength ranging approximately from 470 nm to 510 nm at the point at which the measurement has been carried out. Likewise, the average of the percentage of the intensity of the light reflected from the undercoat layer to the reference intensity within the wavelength range approximately from 750 nm to 800 nm is defined as the reflectance for light having a wavelength ranging approximately from 750 nm to 800 nm at the point at which the measurement has been carried out.

The same measurement is carried out at ten points at regular intervals along the axial direction of the conductive substrate and also performed at points at every 90° from these ten points in the circumferential direction of the conductive substrate; that is, the measurement is performed at 40 points in total. The reflectance for light having a wavelength ranging approximately from 470 nm to 510 nm is determined at each of the points, and the average of the determined reflectance is defined as the reflectance RL for the light having a wavelength ranging approximately from 470 nm to 510 nm. Likewise, the reflectance for light having a wavelength ranging approximately from 750 nm to 800 nm is determined at each of the points, and the average of the determined reflectance is defined as the reflectance RH for the light having a wavelength ranging approximately from 750 nm to 800 nm.

In the case where the reflectance of the undercoat layer in the photoreceptor is measured, the photoreceptor is cut to remove the photosensitive layer. Then, the part from which the photosensitive layer has been removed is optionally cleaned with a solvent or another material to expose the undercoat layer. Then, the exposed undercoat layer is subjected to the above-mentioned measurement of the reflectance of the undercoat layer.

The binder resin used in the undercoat layer will now be described.

Examples of the binder resin used for forming the undercoat layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used for forming the undercoat layer include charge-transporting resins having charge-transporting groups and conductive resins (e.g., polyaniline).

The binder resin used for forming the undercoat layer is suitably insoluble in a solvent used to form the upper layer. In particular, suitable resins are thermosetting resins, such as urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

In the case where two or more of these binder resins are used in combination, the mixture ratio is appropriately determined.

The metal oxide particles will now be described.

Examples of the metal oxide particles include metal oxide particles having a powder resistance (volume resistivity) ranging from $10^2$ Ωcm to $10^{11}$ Ωcm.

Specific examples of the metal oxide particles having such a resistance include tin oxide particles, titanium oxide particles, zinc oxide particles, and zirconium oxide particles; in particular, the metal oxide particles are preferably at least one selected from the group consisting of zinc oxide particles and titanium oxide particles, and especially preferably zinc oxide particles in terms of a reduction in the occurrence of ghosts.

The metal oxide particles may be used alone or in combination.

The average primary particle size of the metal oxide particles is suitably 500 nm or less; in particular, it is preferably in the range of 20 nm to 200 nm, more preferably 30 nm to 150 nm, and further preferably 30 nm to 100 nm.

With a scanning electron microscope (SEM) system, 100 primary particles of the metal oxide particles are analyzed. The primary particles in the obtained SEM image are subjected to an image analysis in order to determine the largest diameter and smallest diameter of each of the particles, and a sphere equivalent diameter is obtained from the median of these diameters. In cumulative frequency of the obtained sphere equivalent diameter based on the number of the particles, 50% diameter (D50p) is defined as the average primary particle size of the metal oxide particles.

The specific surface area of the metal oxide particles, which is measured by a BET method, is, for example, suitably not less than 10 $m^2/g$.

The metal oxide particle content is, for example, preferably in the range of 10 weight % to 80 weight %, and more preferably 40 weight % to 80 weight % relative to the binder resin content.

The metal oxide particles are optionally subjected to a surface treatment.

Examples of a surface treatment agent to be used include a silane coupling agent, a titanate-based coupling agent, an aluminum-based coupling agent, and a surfactant. In particular, a silane coupling agent is preferred, and a silane coupling agent having an amino group is more preferred.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination; for example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Any of known surface treatments with surface treatment agents may be employed, and either of a dry process and a wet process may be performed.

The amount of a surface treatment agent to be used is, for instance, suitably from 0.5 weight % to 10 weight % relative to the metal oxide particle content.

The electron-accepting anthraquinone compound will now be described.

The electron-accepting anthraquinone compound is an electron-accepting compound having an anthraquinone structure. The electron-accepting anthraquinone compound may be a compound of which the anthraquinone structure has a substituent (for instance, a hydroxyl group or an amino group).

Examples of the electron-accepting anthraquinone compound include anthraquinone, alizarin, quinizarin, anthrarufin, and purpurin.

The electron-accepting anthraquinone compound is suitably an electron-accepting anthraquinone compound having a hydroxyl group in terms of a reduction in the occurrence of ghosts. The electron-accepting anthraquinone compound having a hydroxyl group is a compound in which at least one hydrogen atom of the aromatic rings in the anthraquinone structure has been substituted with a hydroxyl group; in particular, a compound represented by General Formula (1) and a compound represented by General Formula (2) are preferred, the compound represented by General Formula (1) is more preferred, and a compound represented by General Formula (1A) is further preferred.

General Formula (1)

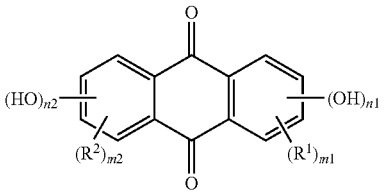

In General Formula (1), n1 and n2 each independently represent an integer from 0 to 4. At least any one of n1 and n2, however, represents an integer from 1 to 4 (in other words, n1 and n2 do not represent 0 at the same time). m1 and m2 each independently represent an integer of 0 or 1. $R^1$ and $R^2$ each independently represent an alkyl group having from 1 to 10 carbon atoms or an alkoxy group having from 1 to 10 carbon atoms.

General Formula (2)

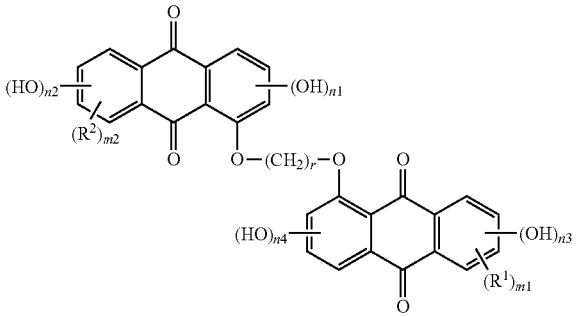

In General Formula (2), n1, n2, n3, and n4 each independently represent an integer from 0 to 3. m1 and m2 each independently represent an integer of 0 or 1. At least any one of n1 and n2 represents an integer from 1 to 3 (in other words, n1 and n2 do not represent 0 at the same time). At least any one of n3 and n4 represents an integer from 1 to 3 (in other words, n3 and n4 do not represent 0 at the same time). r represents an integer from 2 to 10. $R^1$ and $R^2$ each independently represent an alkyl group having from 1 to 10 carbon atoms or an alkoxy group having from 1 to 10 carbon atoms.

In General Formulae (1) and (2), the alkyl group having from 1 to 10 carbon atoms and represented by $R^1$ and $R^2$ may be linear or branched; and examples thereof include a methyl group, an ethyl group, a propyl group, and an isopropyl group. The alkyl group having from 1 to 10 carbon atoms is preferably an alkyl group having from 1 to 8 carbon atoms, and more preferably an alkyl group having from 1 to 6 carbon atoms.

The alkoxy group having from 1 to 10 carbon atoms and represented by $R^1$ and $R^2$ may be linear or branched; and examples thereof include a methoxy group, an ethoxy group, a propoxy group, an isopropoxy group, a butoxy group, and an octoxy group. The alkoxy group having from 1 to 10 carbon atoms is preferably an alkoxy group having from 1 to 8 carbon atoms, and more preferably an alkoxy group having from 1 to 6 carbon atoms.

General Formula (1A)

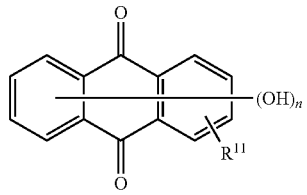

In General Formula (1A), $R^{11}$ represents an alkoxy group having 1 to 10 carbon atoms. n represents an integer from 1 to 8.

In General Formula (1A), the alkoxy group having from 1 to 10 carbon atoms and represented by $R^{11}$ has the same meaning as the alkoxy group having from 1 to 10 carbon atoms and represented by $R^1$ and $R^2$ in General Formula (1), and their preferred ranges are also the same as each other.

In General Formula (1A), n is preferably an integer from 1 to 7, and more preferably an integer from 2 to 5.

Specific examples of the electron-accepting compound will now be described; however, the electron-accepting compound is not limited thereto.

Each of the following specific examples of the compound is referred to as "exemplary compound"; for example, a compound described below of (1-1) is referred to as "exemplary compound (1-1)".

In the following exemplary compounds, "Me" refers to a methyl group, "Et" refers to an ethyl group, "Bu" refers to an n-butyl group, "$C_5H_{11}$" refers to an n-pentyl group, "$C_6H_{13}$" refers to an n-hexyl group, "$C_7H_{15}$" refers to an n-heptyl group, "$C_8H_{17}$" refers to an n-octyl group, "$C_9H_{19}$" refers to an n-nonyl group, and "$C_{10}H_{21}$" refers to an n-decyl group.

1-1

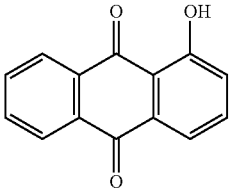

1-2

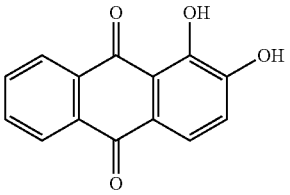

1-3

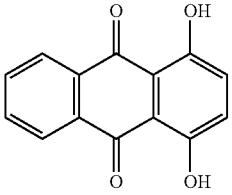

1-4

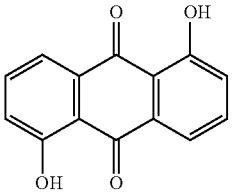

1-5

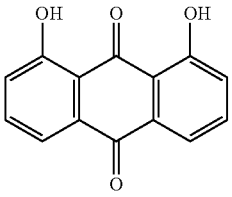

1-6

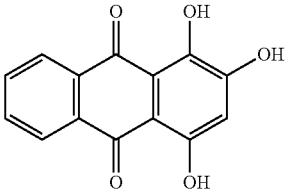

-continued 1-7

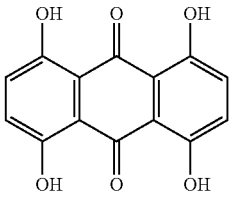

1-8

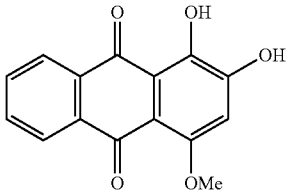

1-9

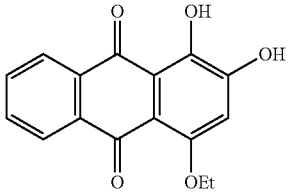

1-10

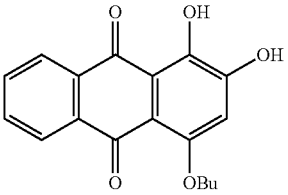

1-11

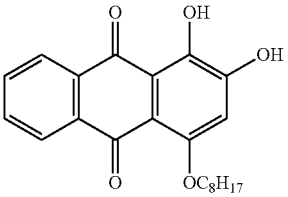

1-12

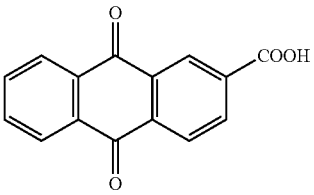

1-13

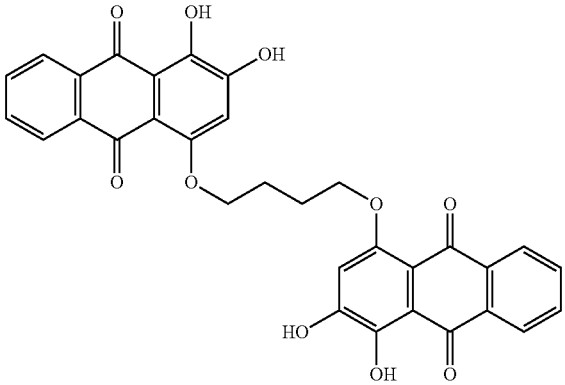

-continued 1-14

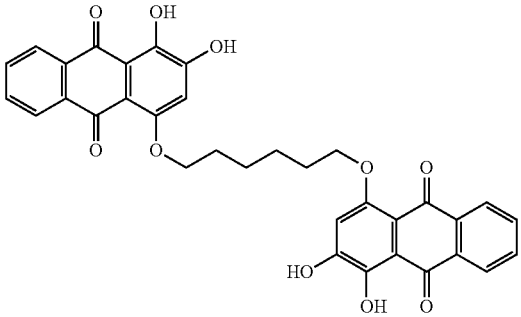

1-15

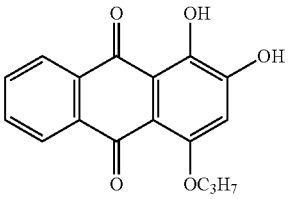

1-16

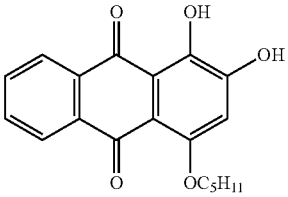

1-18

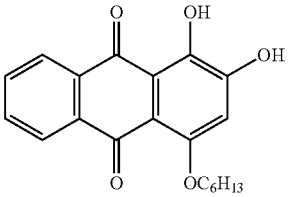

1-19

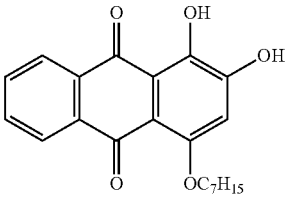

1-20

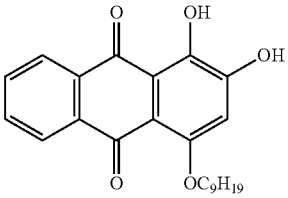

1-21

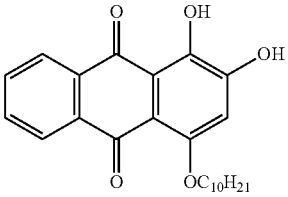

The electron-accepting compound may be contained in the undercoat layer in a state in which it is dispersed along with the metal oxide particles or in a state in which it is adhering to the surfaces of the metal oxide particles.

The electron-accepting compound is allowed to adhere to the surfaces of the metal oxide particles through, for example, a dry process or a wet process.

In a dry process, for instance, the metal oxide particles are stirred with a mixer or another equipment having a large shear force, and the electron-accepting compound itself or a solution of the electron-accepting compound in an organic solvent is dropped or sprayed with dry air or nitrogen gas thereto under the stirring, thereby allowing the electron-accepting compound to adhere to the surfaces of the metal oxide particles. The dropping or spraying of the electron-accepting compound may be performed at a temperature less than or equal to the boiling point of the solvent. After the dropping or spraying of the electron-accepting compound, the resulting product may be optionally baked at not less than 100° C. The baking may be performed at any temperature for any length of time provided that electrophotographic properties can be produced.

In a wet process, for example, the metal oxide particles are dispersed in a solvent by a technique that involves use of stirring, ultrasonic, a sand mill, an attritor, or a ball mill; the electron-accepting compound is added thereto and then stirred or dispersed; and the solvent is subsequently removed, thereby allowing the electron-accepting compound to adhere to the surfaces of the metal oxide particles. The solvent is removed, for instance, by filtration or distillation. After the removal of the solvent, the resulting product may be optionally baked at not less than 100° C. The baking may be performed at any temperature for any length of time provided that electrophotographic properties can be produced. In the wet process, the moisture content in the metal oxide particles may be removed before the addition of the electron-accepting compound; examples of a technique for the removal include a technique in which the moisture is removed in a solvent under stirring and heating and a technique in which the moisture is removed through azeotropy with a solvent.

The electron-accepting compound may be allowed to adhere to the surfaces of the metal oxide particles before or after the metal oxide particles are subjected to the surface treatment with a surface treatment agent, and the process for the adhesion of the electron-accepting compound and the surface treatment may be performed at the same time.

The amount of the electron-accepting compound is, for example, suitably in the range of from 0.01 weight % to 20 weight %, and preferably from 0.01 weight % to 10 weight % relative to the metal oxide particle content.

The undercoat layer may contain a variety of additives to enhance electric properties, environmental stability, and image quality.

Examples of the additives include known materials such as electron-transporting pigments (e.g., condensed polycyclic pigments and azo pigments), zirconium chelate compounds, titanium chelate compounds, aluminum chelate compounds, titanium alkoxide compounds, organic titanium compounds, and silane coupling agents. A silane coupling agent is used for the surface treatment of the metal oxide particles as described above; however, it may be further added, as an additive, to the undercoat layer.

Examples of the silane coupling agents as the additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, ammonium salts of titanium lactate, titanium lactate, ethyl esters of titanium lactate, titanium triethanol aminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or in the form of a mixture or polycondensate of multiple compounds.

The undercoat layer desirably has a Vickers hardness of not less than 35.

The surface roughness (ten-point average roughness) of the undercoat layer is desirably adjusted to be from 1/(4n) (n is a refractive index of the upper layer) to ½ of the wavelength λ of laser light to be used for exposure in order to reduce Moire fringes.

The undercoat layer may contain, for example, resin particles in order to adjust the surface roughness. Examples of the resin particles include silicone resin particles and crosslinkable polymethyl methacrylate resin particles. The surface of the undercoat layer may be polished to adjust the surface roughness. Examples of a polishing technique include buff polishing, sandblasting, wet honing, and grinding.

The undercoat layer may be formed by any technique provided that the intended reflectance RL can be given through the above-mentioned process; for instance, the above-mentioned components are added to a solvent to prepare a coating liquid used for forming the undercoat layer, the coating liquid is used to form a coating film, and the coating film is dried and optionally heated.

Examples of the solvent used in the preparation of the coating liquid used for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of such solvents include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the metal oxide particles in the preparation of the coating liquid used for forming the undercoat layer include known techniques that involve use of a roll mill, a ball mill, a vibratory ball mill, an attritor, a sand mill, a colloid mill, or a paint shaker.

Examples of a technique for applying the coating liquid used for forming the undercoat layer onto the conductive substrate include typical techniques such as blade coating, wire bar coating, spray coating, dip coating, bead coating, air knife coating, and curtain coating.

The thickness of the undercoat layer is, for example, preferably not less than 5 μm, and more preferably from 10 μm to 50 μm.

In particular, in order to adjust the resistance RL to be within the above-mentioned range for a reduction in the occurrence of ghosts, the thickness of the undercoat layer is preferably from 10 to 50 μm, and more preferably from 15 to 35 μm.

Intermediate Layer

Although not illustrated, an intermediate layer may be further provided between the undercoat layer and the photosensitive layer.

An example of the intermediate layer is a layer containing resin. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

These compounds used for forming the intermediate layer may be used alone or in the form of a mixture or polycondensate of multiple compounds.

In particular, the intermediate layer is suitably a layer containing an organic metal compound that contains a zirconium atom or a silicon atom.

The intermediate layer may be formed by any of known techniques; for instance, the above-mentioned components are added to a solvent to prepare a coating liquid used for forming the intermediate layer, the coating liquid is used to form a coating film, and the coating film is dried and optionally heated.

Examples of a technique for applying the coating liquid used for forming the intermediate layer include typical techniques such as dip coating, push-up coating, wire bar coating, spray coating, blade coating, knife coating, and curtain coating.

The thickness of the intermediate layer is suitably adjusted to be, for instance, from 0.1 μm to 3 μm. The intermediate layer may serve as the undercoat layer.

Charge-Generating Layer

An example of the charge-generating layer is a layer containing a charge-generating material and a binder resin. The charge-generating layer may be a deposited layer of a charge-generating material. The deposited layer of a charge-generating material is suitable for the case in which an incoherent light source such as a light emitting diode (LED) or an organic electro-luminescence (EL) image array is used.

Examples of the charge-generating material include azo pigments such as bisazo pigments and trisazo pigments; fused ring aromatic pigments such as dibromoanthanthrone; perylene pigments; pyrrolopyrrole pigments; phthalocyanine pigments; zinc oxide; and trigonal selenium.

In particular, suitable charge-generating materials to enable exposure to laser light having a wavelength that is in a near infrared region are metal phthalocyanine pigments and metal-free phthalocyanine pigments. Specific examples thereof include hydroxygallium phthalocyanine, chlorogallium phthalocyanine, dichlorotin phthalocyanine, and titanyl phthalocyanine.

Suitable charge-generating materials to enable exposure to laser light having a wavelength that is in a near ultraviolet region are fused ring aromatic pigments such as dibromoanthanthrone, thioindigo pigments, porphyrazine compounds, zinc oxide, trigonal selenium, and bisazo pigments.

The above-mentioned charge-generating materials may be used also in the case where an incoherent light source such as an LED or organic EL image array having a central emission wavelength ranging from 450 nm to 780 nm is used; however, when the photosensitive layer has a thickness of not more than 20 μm in terms of resolution, the field intensity in the photosensitive layer becomes high, which easily results in a decrease in the degree of charging due to electric charges injected from the substrate, namely the occurrence of image defects called black spots. This phenomenon is more likely to be caused in the case of using charge-generating materials that are p-type semiconductors and that easily generate dark current, such as trigonal selenium and a phthalocyanine pigment.

Use of charge-generating materials that are n-type semiconductors, such as fused ring aromatic pigments, perylene pigments, and azo pigments, is less likely to generate dark current and enables a reduction in the occurrence of image defects called black spots even at the reduced thickness of the photosensitive layer.

In order to distinguish an n-type charge-generating material, a time-of-flight technique that has been generally employed is used to analyze the polarity of flowing photoelectric current, and a material in which electrons are likely to flow as carriers rather than holes is determined as an n-type charge-generating material.

The binder resin used for forming the charge-generating layer is selected from a variety of insulating resins and may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (such as a polycondensate made from a bisphenol and an aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" herein refers to a volume resistivity of not less than $10^{13}$ Ωm.

These binder resins may be used alone or in combination.

The mixture ratio of the charge-generating material to the binder resin is suitably from 10:1 to 1:10 on a weight basis.

The charge-generating layer may further contain a known additive.

The charge-generating layer may be formed by any of known techniques; for instance, the above-mentioned components are added to a solvent to prepare a coating liquid used for forming the charge-generating layer, the coating liquid is used to form a coating film, and the coating film is dried and optionally heated. The charge-generating layer may be formed by depositing the charge-generating material. Such formation of the charge-generating layer by deposition is suitable particularly in the case of using a fused ring aromatic pigment or a perylene pigment as the charge-generating material.

Examples of the solvent used in the preparation of the coating liquid used for forming the charge-generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination.

Particles (e.g., charge-generating material) are, for example, dispersed in the coating liquid used for forming the charge-generating layer with a disperser involving use of media, such as a ball mill, a vibratory ball mill, an attritor, a sand mill, or horizontal sand mill, or with a media-free disperser such as a stirrer, an ultrasonic disperser, a roll mill, and a high-pressure homogenizer. Examples of the high-pressure homogenizer include an impact-type homogenizer in which a highly pressurized dispersion liquid is allowed to collide with another liquid or a wall for dispersion and a through-type homogenizer in which a highly pressurized dispersion liquid is allowed to flow through a fine flow channel for dispersion.

In this dispersion procedure, it is effective that the average particle size of the charge-generating material used in the coating liquid for forming the charge-generating layer is not more than 0.5 μm, preferably not more than 0.3 μm, and more preferably not more than 0.15 μm.

Examples of a technique for applying the coating liquid used for forming the charge-generating layer onto the undercoat layer (or intermediate layer) include typical techniques such as blade coating, wire bar coating, spray coating, dip coating, bead coating, air knife coating, and curtain coating.

The thickness of the charge-generating layer is, for example, adjusted to be preferably from 0.1 μm to 5.0 μm, and more preferably 0.2 μm to 2.0 μm.

Charge-Transporting Layer

An example of the charge-transporting layer is a layer containing a charge-transporting material and a binder resin. The charge-transporting layer may be a layer containing a charge-transporting polymeric material.

Examples of the charge-transporting material include electron-transporting compounds, e.g., quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, arylalkane compounds, aryl-substituted ethylene compounds, stilbene compounds, anthracene compounds, and hydrazone compounds. These charge-transporting materials are used alone or in combination but not limited thereto.

The charge-transporting material is suitably any of triarylamine derivatives represented by Structural Formula (a-1) or any of benzidine derivatives represented by Structural Formula (a-2) in terms of charge mobility.

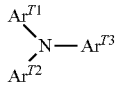

(a-1)

In Structural Formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—$ CH═CH—CH═C($R^{T7}$)($R^{T8}$). $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent of each of these groups include a halogen atom, an alkyl group having from 1 to 5 carbon atoms, and an alkoxy group having from 1 to 5 carbon atoms. Another example of the substituent is a substituted amino group that is substituted with an alkyl group having from 1 to 3 carbon atoms.

(a-2)

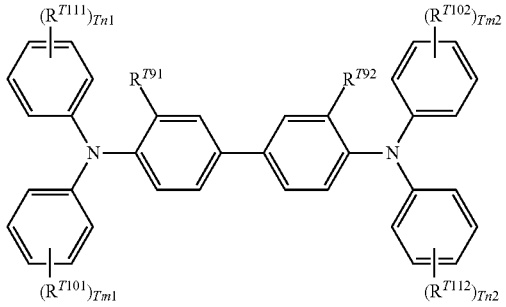

In Structural Formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$, and $R^{T112}$ each independently represent a halogen atom, an alkyl group having from 1 to 5 carbon atoms, an alkoxy group having from 1 to 5 carbon atoms, an amino group substituted with an alkyl group having from 1 or 2 carbon atoms, a substituted or unsubstituted aryl group, —C($R^{T12}$)═C($R^{T13}$)($R^{T14}$), or —CH═CH—CH═C($R^{T15}$)($R^{T16}$); $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer from 0 to 2.

Examples of the substituent of each of these groups include a halogen atom, an alkyl group having from 1 to 5 carbon atoms, and an alkoxy group having from 1 to 5 carbon atoms. Another example of the substituent is a substituted amino group that is substituted with an alkyl group having from 1 to 3 carbon atoms.

Among the triarylamine derivatives represented by Structural Formula (a-1) and the benzidine derivatives represented by Structural Formula (a-2), a triarylamine derivative having a part "—$C_6H_4$—CH═CH—CH═C($R^{T7}$)($R^{T8}$)" and a benzidine derivative having a part "—CH═CH—CH═C($R^{T15}$)($R^{T16}$)" are suitable in terms of charge mobility.

Examples of the charge-transporting polymeric material include known materials having a charge transportability, such as poly-N-vinylcarbazole and polysilane. In particular, charge-transporting polymeric materials involving polyester are especially suitable. The charge-transporting polymeric material may be used alone or in combination with a binder resin.

Examples of the binder resin used in the charge-transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are suitably used as the binder resin. These binder resins are used alone or in combination.

The mixing ratio of the charge-transporting material to the binder resin is suitably from 10:1 to 1:5 on a weight basis.

The charge-transporting layer may further contain a known additive.

The charge-transporting layer may be formed by any of known techniques; for instance, the above-mentioned components are added to a solvent to prepare a coating liquid used for forming the charge-transporting layer, the coating liquid is used to form a coating film, and the coating film is dried and optionally heated.

Examples of the solvent used in the preparation of the coating liquid used for forming the charge-transporting layer include typical organic solvents, e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofuran and ethyl ether. These solvents are used alone or in combination.

Examples of a technique for applying the coating liquid used for forming the charge-transporting layer onto the charge-generating layer include typical techniques such as blade coating, wire bar coating, spray coating, dip coating, bead coating, air knife coating, and curtain coating.

The thickness of the charge-transporting layer is, for instance, adjusted to be preferably from 5 μm to 50 μm, and more preferably from 10 μm to 30 μm.

Protective Layer

The protective layer is optionally formed on the photosensitive layer. The protective layer is formed, for instance, in order to prevent the photosensitive layer from being chemically changed in the charging and to improve the mechanical strength of the photosensitive layer.

Hence, the protective layer is properly a layer of a cured film (crosslinked film). Examples of such a layer include the following layers (1) and (2).

(1) Layer of a cured film made of a composition that contains a reactive-group-containing charge-transporting material of which one molecule has both a reactive group and a charge-transporting skeleton (in other words, layer containing a polymer or crosslinked product of the reactive-group-containing charge-transporting material)

(2) Layer of a cured film made of a composition that contains a nonreactive charge-transporting material and a reactive-group-containing non-charge-transporting material that does not have a charge-transporting skeleton but has a reactive group (in other words, layer containing polymers or crosslinked products of the nonreactive charge-transporting material and reactive-group-containing non-charge-transporting material)

Examples of the reactive group of the reactive-group-containing charge-transporting material include known reactive groups such as a chain polymerizable group, an epoxy group, —OH, —OR (where R represents an alkyl group), —$NH_2$, —SH, —COOH, and —$SiR^{Q1}{}_{3-Qn}$ $(OR^{Q2})_{Qn}$ (where $R^{Q1}$ represents a hydrogen atom, an alkyl group, or a substituted or unsubstituted aryl group; $R^{Q2}$ represents a hydrogen atom, an alkyl group, or a trialkylsilyl group; and Qn represents an integer from 1 to 3).

Any chain polymerizable group may be employed provided that it is a functional group that enables a radical polymerization; for example, a functional group at least having a group with a carbon double bond may be employed. Specific examples thereof include groups containing at least one selected from a vinyl group, a vinyl ether group, a vinyl thioether group, a styryl group (vinylphenyl group), an acryloyl group, a methacryloyl group, and derivatives thereof. Among these, suitable chain polymerizable groups are groups containing at least one selected from a vinyl group, a styryl group (vinylphenyl group), an acryloyl group, a methacryloyl group, and derivatives thereof because they have excellent reactivity.

The charge-transporting skeleton of the reactive-group-containing charge-transporting material is not particularly limited provided that it is a known structure in the field of electrophotographic photoreceptors. Examples of such a structure include skeletons that are derived from nitrogen-containing hole-transporting compounds, such as triarylamine compounds, benzidine compounds, and hydrazone compounds, and that are conjugated with a nitrogen atom. In particular, triarylamine skeletons are suitable.

The reactive-group-containing charge-transporting material having both a reactive group and a charge-transporting skeleton, the nonreactive charge-transporting material, and the reactive-group-containing non-charge transporting material may be selected from known materials.

The protective layer may further contain a known additive.

The protective layer may be formed by any of known techniques; for instance, the above-mentioned components are added to a solvent to prepare a coating liquid used for forming the protective layer, the coating liquid is used to form a coating film, and the coating film is dried and optionally heated for curing.

Examples of the solvent used in the preparation of the coating liquid used for forming the protective layer include aromatic hydrocarbon solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or in combination.

The coating liquid used for forming the protective layer may be a solventless coating liquid.

Examples of a technique for applying the coating liquid used for forming the protective layer onto the photosensitive layer (e.g., charge-transporting layer) include typical techniques such as dip coating, push-up coating, wire bar coating, spray coating, blade coating, knife coating, and curtain coating.

The thickness of the protective layer is, for instance, adjusted to be preferably from 1 μm to 20 μm, and more preferably from 2 μm to 10 μm.

Single Photosensitive Layer

The single photosensitive layer (charge-generating/charge-transporting layer) is, for example, a layer containing a charge-generating material, a charge-transporting material, and optionally a binder resin and another known additive. These materials are the same as those described as the materials used for forming the charge-generating layer and the charge-transporting layer.

The amount of the charge-generating material contained in the single photosensitive layer is suitably from 10 weight % to 85 weight %, and preferably from 20 weight % to 50 weight % relative to the total solid content. The amount of the charge-transporting material contained in the single photosensitive layer is suitably from 5 weight % to 50 weight % relative to the total solid content.

The single photosensitive layer is formed by the same technique as those for forming the charge-generating layer and the charge-transporting layer.

The thickness of the single photosensitive layer is, for instance, suitably from 5 μm to 50 μm, and preferably from 10 μm to 40 μm.

Image Forming Apparatus (and Process Cartridge)

An image forming apparatus according to a second exemplary embodiment includes an electrophotographic photoreceptor, a charging device that serves to charge the surface of the electrophotographic photoreceptor, an electrostatic latent image forming device that serves to form an electrostatic latent image on the surface of the charged electrophotographic photoreceptor, a developing device that serves to develop the electrostatic latent image on the surface of the electrophotographic photoreceptor with a developer containing toner to form a toner image, and a transfer device that serves to transfer the toner image to the surface of a recording medium. The electrophotographic photoreceptor is the electrophotographic photoreceptor according to the first exemplary embodiment.

The image forming apparatus according to the second exemplary embodiment may be any of the following known image forming apparatuses: an apparatus which has a fixing device that serves to fix the toner image transferred to the surface of a recording medium, a direct-transfer-type apparatus in which the toner image formed on the surface of the electrophotographic photoreceptor is directly transferred to a recording medium, an intermediate-transfer-type apparatus in which the toner image formed on the surface of the electrophotographic photoreceptor is subjected to first transfer to the surface of an intermediate transfer body and in which the toner image transferred to the surface of the intermediate transfer body is then subjected to second transfer to the surface of a recording medium, an apparatus which has a cleaning device that serves to clean the surface of the electrophotographic photoreceptor after the transfer of a toner image and before the charging of the electrophotographic photoreceptor, an apparatus which has a charge-neutralizing device that serves to radiate light to the surface of the electrophotographic photoreceptor for removal of charges after the transfer of a toner image and before the charging of the electrophotographic photoreceptor, and an apparatus which has an electrophotographic photoreceptor heating member that serves to heat the electrophotographic photoreceptor to decrease the relative temperature.

In the case where the charge-neutralizing device that serves to remove charges on the surface of the electrophotographic photoreceptor after the transfer of a toner image (namely, after a toner image formed on the electrophotographic photoreceptor is transferred by the transfer device) and before the charging of the electrophotographic photoreceptor (namely, before the surface of the electrophotographic photoreceptor is charged by the charging device) is not provided, charges are accumulated particularly at the interface between the photosensitive layer and the undercoat layer, which readily results in the occurrence of ghosts. Use of the electrophotographic photoreceptor of the first exemplary embodiment, however, enables an easy reduction in the occurrence of ghosts without the charge-neutralizing device.

In the intermediate-transfer-type apparatus, the transfer device, for example, includes an intermediate transfer body of which a toner image is to be transferred to the surface, a first transfer device which serves for first transfer of the toner image formed on the surface of the electrophotographic photoreceptor to the surface of the intermediate transfer body, and a second transfer device which serves for second transfer of the toner image transferred to the surface of the intermediate transfer body to the surface of a recording medium.

The image forming apparatus according to the second exemplary embodiment may be either of a dry development type and a wet development type (development with a liquid developer is performed).

In the structure of the image forming apparatus according to the second exemplary embodiment, for instance, the part that includes the electrophotographic photoreceptor may be in the form of a cartridge that is removably attached to the image forming apparatus (process cartridge). A suitable example of the process cartridge to be used is a process cartridge including the electrophotographic photoreceptor according to the first exemplary embodiment. The process cartridge may include, in addition to the electrophotographic photoreceptor, at least one selected from the group consisting of, for example, the charging device, the electrostatic latent image forming device, the developing device, and the transfer device.

An example of the image forming apparatus according to the second exemplary embodiment will now be described; however, the image forming apparatus according to the second exemplary embodiment is not limited thereto. The parts shown in the drawings are described, while description of the other parts is omitted.

Figure 4:
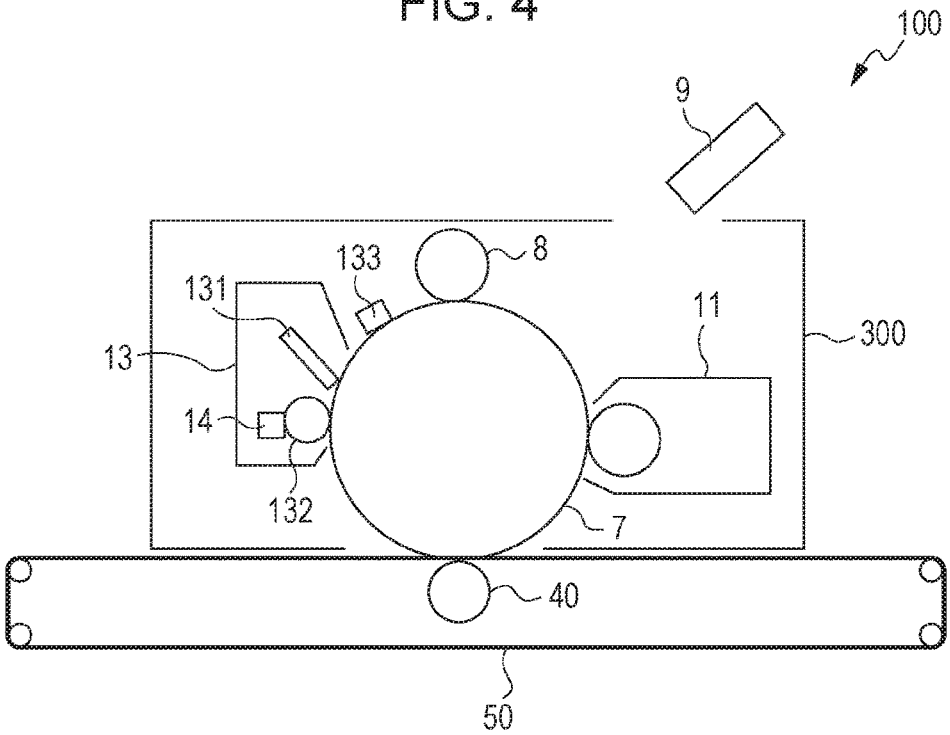
FIG. 4 schematically illustrates the structure of an image forming apparatus according to a second exemplary embodiment.

FIG. 4 schematically illustrates an example of the structure of the image forming apparatus according to the second exemplary embodiment.

As illustrated in FIG. 4, an image forming apparatus 100 according to the second exemplary embodiment includes a process cartridge 300 having an electrophotographic photoreceptor 7, an exposure device 9 (example of the electrostatic latent image forming device), a transfer device 40 (first transfer device), and an intermediate transfer body 50. In the image forming apparatus 100, the exposure device 9 is disposed such that the electrophotographic photoreceptor 7 can be irradiated with light through the opening of the process cartridge 300, the transfer device 40 is disposed so as to face the electrophotographic photoreceptor 7 with the intermediate body 50 interposed therebetween, and the intermediate body 50 is placed such that part thereof is in contact with the electrophotographic photoreceptor 7. Although not illustrated, the image forming apparatus also includes a second transfer device that serves to transfer a toner image transferred to the intermediate transfer body 50 to a recording medium (e.g., paper). In this case, the intermediate transfer body 50, the transfer device 40 (first transfer device), and the second transfer device (not illustrated) are an example of the transfer device.

In the process cartridge 300 illustrated in FIG. 4, a housing integrally accommodates the electrophotographic photoreceptor 7, the charging device 8 (example of the charging device), the developing device 11 (example of the developing device), and the cleaning device 13 (example of the cleaning device). The cleaning device 13 has a cleaning blade 131 (example of a cleaning member), and the cleaning blade 131 is disposed so as to be in contact with the surface of the electrophotographic photoreceptor 7. The cleaning member does not need to be in the form of the cleaning blade 131 but may be a conductive or insulating fibrous member; this fibrous member may be used alone or in combination with the cleaning blade 131.

The example of the image forming apparatus in FIG. 4 includes a fibrous member 132 (roll) that serves to supply a lubricant 14 to the surface of the electrophotographic photoreceptor 7 and a fibrous member 133 (flat brush) that supports the cleaning, and these members are optionally placed.

Each part of the image forming apparatus according to the second exemplary embodiment will now be described.

Charging Device

Examples of the charging device 8 includes contact-type chargers that involve use of a conductive or semi-conductive charging roller, charging brush, charging film, charging rubber blade, or charging tube. Any of other known chargers may be used, such as a non-contact-type roller charger and a scorotron or coroton charger in which corona discharge is utilized.

Exposure Device

Examples of the exposure device 9 include optical systems that expose the surface of the electrophotographic photoreceptor 7 to light, such as light emitted from a semiconductor laser, an LED, or a liquid crystal shutter, in the shape of the intended image. The wavelength of light source is within the spectral sensitivity of the electrophotographic photoreceptor. The light from a semiconductor laser is generally near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. A surface-emitting laser source that can emit multiple beams is also effective for formation of color images.

Developing Device

Examples of the developing device 11 is general developing devices that develop images through contact or non-contact with a developer. The developing device 11 is not particularly limited provided that it has the above-mentioned function, and a proper structure for the intended use is selected. An example of the developing device 11 is a known developing device that serves to attach a one-component or two-component developer to the electrophotographic photoreceptor 7 with a brush or a roller. In particular, a developing device including a developing roller of which the surface holds a developer is suitable.

The developer used in the developing device 11 may be either of a one-component developer of toner alone and a two-component developer containing toner and a carrier. The developer may be either magnetic or nonmagnetic. Any of known developers may be used.

Cleaning Device

The cleaning device 13 is a cleaning-blade type in which the cleaning blade 131 is used.

The cleaning device 13 may have a structure other than the cleaning-blade type; in particular, fur brush cleaning may be employed, or the cleaning may be performed at the same time as the developing.

Transfer Device

Examples of the transfer device 40 include known transfer chargers such as contact-type transfer chargers having a belt, a roller, a film, or a rubber blade and non-contact-type transfer chargers in which corona discharge is utilized, e.g., a scorotron transfer charger and a corotron transfer charger.

Intermediate Transfer Body

The intermediate transfer body 50 is, for instance, in the form of a belt (intermediate transfer belt) containing a semi-conductive polyimide, polyamide imide, polycarbonate, polyarylate, polyester, or rubber. The intermediate transfer body may be in the form other than a belt, such as a drum.

Figure 5:
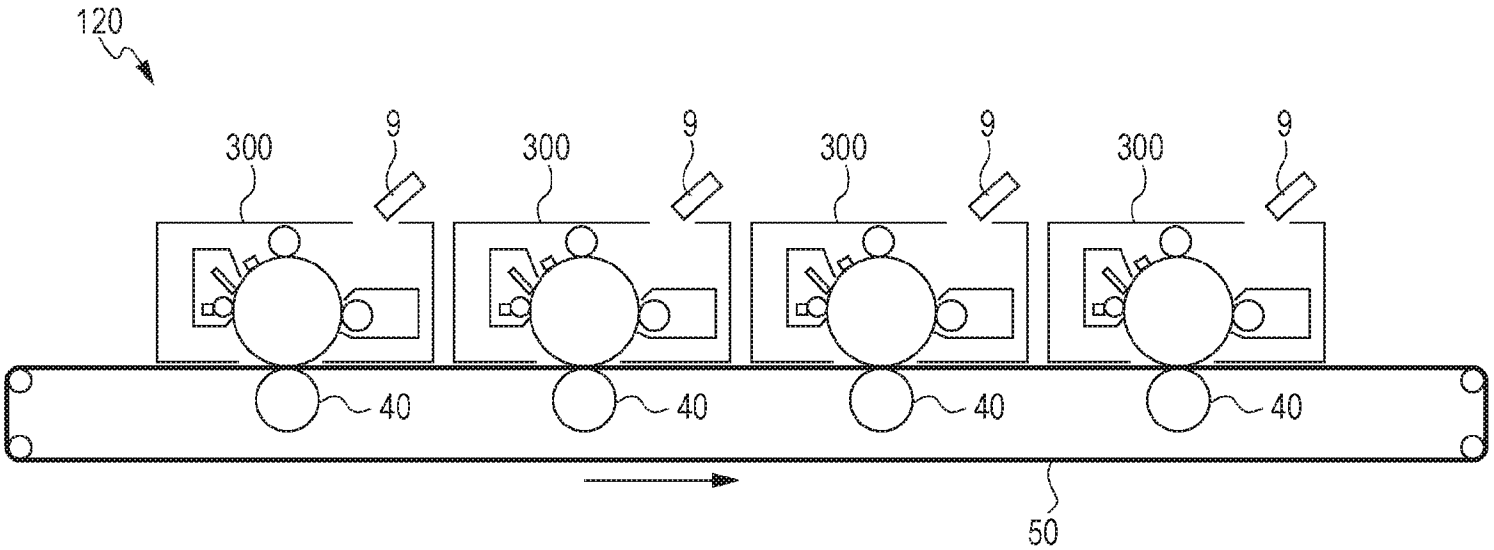
FIG. 5 schematically illustrates the structure of another image forming apparatus according to the second exemplary embodiment.

FIG. 5 schematically illustrates another example of the structure of the image forming apparatus according to the second exemplary embodiment.

An image forming apparatus 120 illustrated in FIG. 5 is a tandem-type multicolor image forming apparatus including four process cartridges 300. In the image forming apparatus 120, the four process cartridges 300 are disposed in parallel so as to overlie the intermediate transfer body 50, and one electrophotographic photoreceptor serves for one color. Except that the image forming apparatus 120 is a tandem type, it has the same structure as the image forming apparatus 100.

The structure of the image forming apparatus 100 of the second exemplary embodiment is not limited to the above-mentioned structure. For instance, a first charge-neutralizing device that makes residual toner have the same polarity to easily remove the residual toner with a cleaning brush may be provided around the electrophotographic photoreceptor 7 downstream of the transfer device 40 and upstream of the cleaning device 13 in the rotational direction of the electrophotographic photoreceptor 7. Furthermore, a second charge-neutralizing device that neutralizes the charge on the surface of the electrophotographic photoreceptor 7 may be provided downstream of the cleaning device 13 and upstream of the charging device 8 in the rotational direction of the electrophotographic photoreceptor 7.

The structure of the image forming apparatus 100 of the second exemplary embodiment is not limited to the above-mentioned structure and may have a known structure; for instance, a direct transfer system may be employed, in which a toner image formed on the electrophotographic photoreceptor 7 is directly transferred to a recording medium.

EXAMPLES

Exemplary embodiments of the invention will now be described in detail with reference to Examples but are not limited thereto. In the following description, the terms "part" and "%" are on a weight basis unless otherwise specified.

Example 1

Formation of Undercoat Layer

The following materials are mixed with each other: 100 parts by weight of zinc oxide particles as metal oxide particles (trade name: MZ-300, manufactured by TAYCA CORPORATION, average primary particle size: 35 nm), 10 parts by weight of a 10 weight % solution of N-β(aminoethyl)γ-aminopropyltriethoxysilane in toluene as a silane coupling agent, and 200 parts by weight of toluene. Then, the mixture is stirred and subsequently refluxed for two hours. The toluene is distilled off under reduced pressure at 10 mmHg, and the resulting product is baked at 135° C. for 2 hours for surface treatment.

Then, 33 parts by weight of the surface-treated zinc oxide is mixed with 6 parts by weight of a blocked isocyanate (trade name: Sumidur 3175, manufactured by Sumitomo Bayer Urethane Co., Ltd.), 1 part by weight of an electron-accepting anthraquinone compound represented by Formula (X) as an electron-accepting compound, and 25 parts by weight of methyl ethyl ketone over 30 minutes. Then, 5 parts by weight of a butyral resin (trade name: S-LEC BM-1, manufactured by SEKISUI CHEMICAL CO., LTD.), 3 parts by weight of silicone balls (trade name: Tospearl 120 manufactured by Momentive Performance Materials Inc.), and 0.01 part by weight of a silicone oil (trade name: SH29PA, manufactured by Dow Corning Toray Silicone Co., Ltd.) as a leveling agent are added to the mixture. The resulting mixture is subjected to first dispersion with a sand mill (trade name: DYNO-MILL, manufactured by SHINMARU ENTERPRISES CORPORATION) at a disk-rotational speed of 1600 rpm for 4 hours. The disk-rotational speed of the sand mill is reduced by half (800 rpm) to perform second dispersion for 12 hours, thereby producing a coating liquid used for forming an undercoat layer Formula (X)

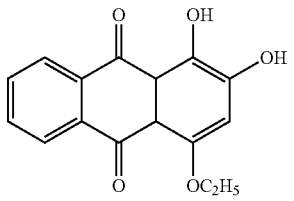

The coating liquid used for forming an undercoat layer is applied onto an aluminum substrate having a diameter of 40 mm, a length of 340 mm, and a thickness of 1.0 mm by dip coating and dried and cured at 180° C. for 30 minutes to form an undercoat layer having a thickness of 23.5 μm.

Formation of Charge-Generating Layer

A mixture containing 18 parts by weight of a hydroxygallium phthalocyanine pigment as a charge-generating material, 16 parts by weight of a vinyl chloride-vinyl acetate copolymer resin (trade name: VMCH, manufactured by Nippon Unicar Company Limited) as a binder resin, and 100 parts by weight of n-butyl acetate is put into a glass bottle having a capacity of 100 mL, and glass beads having a diameter of 1.0 mm are also put thereinto at a filling rate of 50%. The content is subjected to dispersion with a paint shaker for 2.5 hours to produce a coating liquid used for forming a charge-generating layer. This coating liquid is applied to the undercoat layer by dip coating and dried at 100° C. for 5 minutes to form a charge-generating layer having a thickness of 0.20 μm.

Formation of Charge-Transporting Layer

To 60 parts by weight of tetrahydrofuran, 2 parts by weight of a compound represented by Formula (CT1), 2 parts by weight of a compound represented by Formula (CT2), and 6 parts by weight of a polycarbonate copolymer resin represented by Formula (PC1) (molecular weight of 40,000) are added and dissolved, thereby producing a coating liquid used for forming a charge-transporting layer. This coating liquid used for forming a charge-transporting layer is applied to the charge-generating layer by dip coating and dried at 150° C. for 30 minutes to form a charge-transporting layer having a thickness of 24 μm.

(CT1)

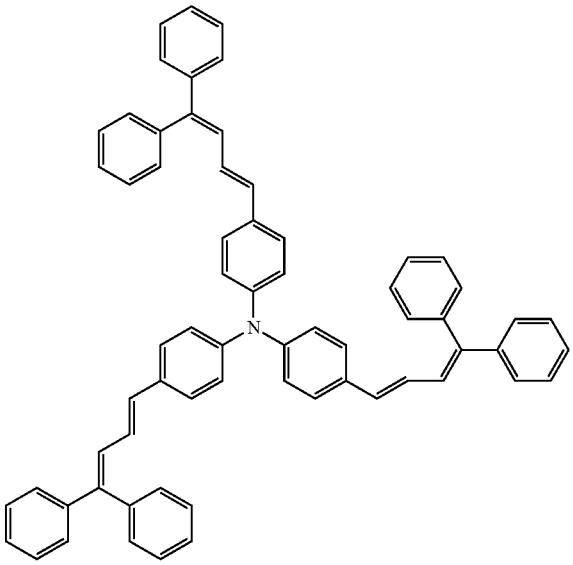

(CT2)

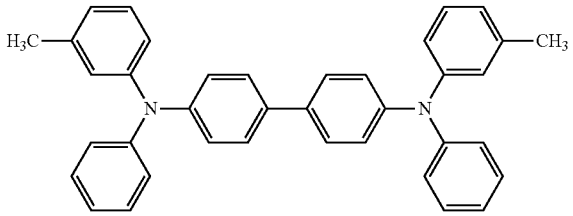

(PC1)

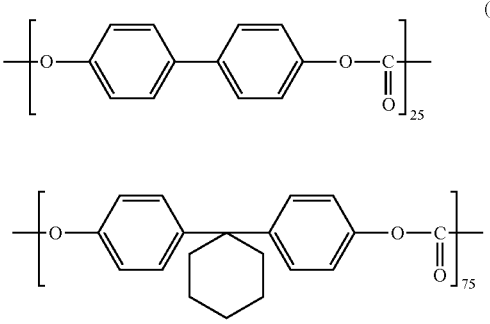

Through this process, an electrophotographic photoreceptor of Example 1 has been produced. Examples 2 to 11 and Comparative Examples 1 to 3

The conditions of the first and second dispersion in the preparation of the coating liquid used for forming the undercoat layer; the thickness of the undercoat layer; the type, average primary particle size (D50p), and amount of the metal oxide particles (amount of the surface-treated metal oxide particles); and the type and amount of the electron-accepting compound are changed as shown in Table 1. Except for these changes, electrophotographic photoreceptors of Examples 2 to 11 and Comparative Examples 1 to 3 are produced as in Example 1.

In Examples 6 and 7, zinc oxide particles (trade name: MZ-200, manufactured by TAYCA CORPORATION, average primary particle size: 50 nm) are used as the metal oxide particles.

In Example 9, titanium oxide particles (trade name: TAF500J, manufactured by Fuji Titanium Industry Co., Ltd., average primary particle size: 50 nm) are used as the metal oxide particles.

In Example 10, tin oxide particles (trade name: S-1, manufactured by Mitsubishi Materials Corporation, average primary particle size: 25 nm) are used as the metal oxide particles.

In Example 11, an electron-accepting anthraquinone compound represented by Formula (Y) is used as the electron-accepting compound.

Formula (Y)

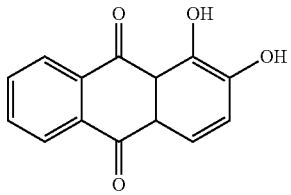

Measurement

When the formation of the undercoat layer is completed in the production of the electrophotographic photoreceptor of each of Examples, the undercoat layer is subjected to measurement of reflectance RL for light having a wavelength ranging approximately from 470 nm to 510 nm and reflectance RH for light having a wavelength ranging approximately from 750 nm to 800 nm in the manner described above.

Evaluation

Evaluation of Ghosts

The electrophotographic photoreceptors produced in Examples are individually attached to an electrophotographic image-forming apparatus (DocuCentre-V C7776 manufactured by Fuji Xerox Co., Ltd.) that has been modified so that an erase lamp can be turned off, and then images are output at an air temperature of 10° C. and a relative humidity RH of 15%.

In particular, 100 sheets of A3 paper of which a half-tone image has been formed on the entire surfaces at an image density of 30% are output in sequence. Then, a sheet of A3 paper on which an image of a 2-cm square has been formed at an image density of 100% and on which a half-tone image has been formed posterior to the square image at an interval corresponding to the circumference of the photoreceptor (approximately 94 mm) at an image density of 30% is output and used as an image for evaluating ghosts. This image for evaluating ghosts is used to visually observe the occurrence of ghosts of the square image on the half-tone image of 30% image density.

The image is subjected to a sensory evaluation and graded. The grades are from G0 to G5, one by one; the smaller the number appended to "G" is, the better the evaluation result is (in other words, ghosts less occur). In the evaluation of ghosts, grades of G3 or better are acceptable.

The evaluation of ghosts is carried out both in the case where the erase lamp has been turned on (charges are removed) and in the case where the erase lamp has been turned off (charges are not removed).

TABLE 1

| | Coating liquid used for forming undercoat layer | | | | | | | | | |
|---|---|---|---|---|---|---|---|---|---|---|
| | Metal oxide particles | | | Electron-accepting material | | First dispersion | | Second dispersion | | Thickness of undercoat layer |
| | Type | D50p (nm) | Amount | Type | Amount | Rotational speed (rpm) | Time (h) | Rotational speed (rpm) | Time (h) | (μm) |
| Example 1 | Zinc oxide | 35 | 33 | Formula (X) = (I-9) | 1 | 1600 | 4 | 800 | 12 | 23.5 |
| Example 2 | Zinc oxide | 35 | 33 | Formula (X) = (I-9) | 1 | 1600 | 3 | 800 | 8 | 23.5 |
| Example 3 | Zinc oxide | 35 | 33 | Formula (X) = (I-9) | 1 | 1600 | 3 | 800 | 4 | 23.5 |
| Example 4 | Zinc oxide | 35 | 33 | Formula (X) = (I-9) | 1 | 1600 | 4 | 800 | 12 | 15.0 |
| Example 5 | Zinc oxide | 35 | 33 | Formula (X) = (I-9) | 1 | 1600 | 4 | 800 | 12 | 32.0 |
| Example 6 | Zinc oxide | 50 | 33 | Formula (X) = (I-9) | 1 | 1600 | 4 | 800 | 12 | 23.5 |
| Example 7 | Zinc oxide | 50 | 33 | Formula (X) = (I-9) | 1 | 1600 | 4 | 800 | 12 | 23.5 |
| Example 8 | Zinc oxide | 35 | 33 | Formula (X) = (I-9) | 1 | 1600 | 4 | 400 | 8 | 23.5 |
| Example 9 | Titanium oxide | 50 | 33 | Formula (X) = (I-9) | 1 | 1600 | 4 | 800 | 12 | 15 |
| Example 10 | Tin oxide | 25 | 33 | Formula (X) = (I-9) | 1 | 1600 | 4 | 800 | 12 | 15 |
| Example 11 | Zinc oxide | 35 | 33 | Formula (Y) = (I-2) | 1 | 1600 | 4 | 800 | 12 | 23.5 |
| Comparative Example 1 | Zinc oxide | 35 | 33 | Formula (X) = (I-9) | 1 | 1600 | 2 | 800 | 6 | 23.5 |
| Comparative Example 2 | Zinc oxide | 35 | 33 | Formula (X) = (I-9) | 1 | 1600 | 6 | 800 | 20 | 23.5 |
| Comparative Example 3 | Zinc oxide | 35 | 33 | None | — | 1600 | 4 | 800 | 12 | 23.5 |

TABLE 2

| | Evaluation of reflectance of undercoat layer | | | Evaluation of ghosts | |
|---|---|---|---|---|---|
| | Reflectance RL (%) | Reflectance RH (%) | RL/RH (%) | Charges removed | Charges not removed |
| Example 1 | 3.3 | 35 | 9 | G0 | G1 |
| Example 2 | 3.9 | 32 | 12 | G1 | G2 |
| Example 3 | 4.8 | 27 | 17 | G2 | G2 |
| Example 4 | 3.2 | 41 | 8 | G1 | G1 |
| Example 5 | 3.5 | 29 | 12 | G2 | G3 |
| Example 6 | 2.4 | 25 | 10 | G0 | G0 |
| Example 7 | 4.2 | 19 | 22 | G1 | G3 |
| Example 8 | 2.0 | 45 | 4 | G3 | G3 |
| Example 9 | 3.8 | 23 | 16 | G2 | G1 |
| Example 10 | 3.5 | 19 | 18 | G3 | G3 |
| Example 11 | 2.8 | 35 | 8 | G1 | G1 |
| Comparative Example 1 | 7.0 | 25 | 28 | G3 | G5 |
| Comparative Example 2 | 1.5 | 18 | 8 | G4 | G4 |
| Comparative Example 3 | 15 | 20 | 75 | G5 | G5 |

The results show that the occurrence of ghosts is reduced in Examples as compared with Comparative Examples. In particular, in the case where an erase lamp is turned off, ghosts tend to easily occur; however, in Examples, the occurrence of ghosts is reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an undercoat layer disposed on the conductive substrate and containing a binder resin, metal oxide particles, and an electron-accepting compound having an anthraquinone structure; and a photosensitive layer disposed on the undercoat layer, wherein the reflectance RL of the undercoat layer for light having a wavelength ranging approximately from 470 nm to 510 nm is approximately from 2% to 5%.

2. The electrophotographic photoreceptor according to claim 1, wherein the reflectance RL for light having a wavelength ranging approximately from 470 nm to 510 nm is approximately from 2% to 4%.

3. The electrophotographic photoreceptor according to claim 1, wherein the percentage of the reflectance RL for light having a wavelength ranging approximately from 470 nm to 510 nm to reflectance RH for light having a wavelength ranging approximately from 750 nm to 800 nm is approximately from 5% to 20%.

4. The electrophotographic photoreceptor according to claim 1, wherein the percentage of the reflectance RL for light having a wavelength ranging approximately from 470 nm to 510 nm to reflectance RH for light having a wavelength ranging approximately from 750 nm to 800 nm is approximately from 5% to 15%.

5. The electrophotographic photoreceptor according to claim 1, wherein the percentage of the reflectance RL for light having a wavelength ranging approximately from 470 nm to 510 nm to reflectance RH for light having a wavelength ranging approximately from 750 nm to 800 nm is approximately from 7% to 10%.

6. The electrophotographic photoreceptor according to claim 1, wherein the metal oxide particles are at least one selected from the group consisting of zinc oxide particles and titanium oxide particles.

7. The electrophotographic photoreceptor according to claim 1, wherein the metal oxide particles are zinc oxide particles.

8. A process cartridge comprising the electrophotographic photoreceptor according to claim 1, wherein the process cartridge is removably attached to an image forming apparatus.

9. An image forming apparatus comprising:

the electrophotographic photoreceptor according to claim 1;

a charging device that serves to charge the surface of the electrophotographic photoreceptor;

an electrostatic latent image forming device that serves to form an electrostatic latent image on the surface of the charged electrophotographic photoreceptor;

a developing device that serves to develop the electrostatic latent image on the surface of the electrophotographic photoreceptor with a developer containing toner to form a toner image; and a transfer device that serves to transfer the toner image to the surface of a recording medium.

10. The image forming apparatus according to claim 9, wherein the image forming apparatus is free from use of a charge-neutralizing device that serves to remove charges on the surface of the electrophotographic photoreceptor after the toner image formed on the surface of the electrophotographic photoreceptor is transferred by the transfer device and before the surface of the electrophotographic photoreceptor is charged by the charging device.

* * * * *